US009746160B2

(12) United States Patent
Kozuru et al.

(10) Patent No.: US 9,746,160 B2
(45) Date of Patent: Aug. 29, 2017

(54) LIGHT EMITTING DEVICE AND METHOD OF MANUFACTURING LIGHT EMITTING DEVICE

(71) Applicant: NICHIA CORPORATION, Anan-shi, Tokushima (JP)

(72) Inventors: Kazuma Kozuru, Anan (JP); Eiichiro Okahisa, Tokushima (JP)

(73) Assignee: NICHIA CORPORATION, Anan-Shi (JP)

( * ) Notice: Subject to any disclaimer, the term of this patent is extended or adjusted under 35 U.S.C. 154(b) by 0 days.

(21) Appl. No.: 15/221,062

(22) Filed: Jul. 27, 2016

(65) Prior Publication Data

US 2017/0030559 A1 Feb. 2, 2017

(30) Foreign Application Priority Data

Jul. 28, 2015 (JP) ..... 2015-148873
Jul. 15, 2016 (JP) ..... 2016-140086

(51) Int. Cl.

| | |
|---|---|
| ***F21V 17/10*** | (2006.01) |
| ***F21V 7/00*** | (2006.01) |
| ***F21V 31/00*** | (2006.01) |
| ***F21V 29/00*** | (2015.01) |
| ***F21V 15/01*** | (2006.01) |
| *F21K 9/90* | (2016.01) |
| *F21Y 105/00* | (2016.01) |
| *F21Y 115/30* | (2016.01) |

(52) U.S. Cl.

CPC ..... *F21V 17/101* (2013.01); *F21V 7/0083* (2013.01); *F21V 15/01* (2013.01); *F21V 29/00* (2013.01); *F21K 9/90* (2013.01); *F21V 31/005* (2013.01); *F21Y 2105/00* (2013.01); *F21Y 2115/30* (2016.08)

(58) Field of Classification Search

CPC .... F21V 17/101; F21V 7/0083; F21V 31/005; F21K 9/90

See application file for complete search history.

(56) References Cited

U.S. PATENT DOCUMENTS

| | | | |
|---|---|---|---|
| 2012/0091500 | A1 | 4/2012 | Matoba et al. |
| 2014/0197528 | A1 | 7/2014 | Nagata |

FOREIGN PATENT DOCUMENTS

| | | | |
|---|---|---|---|
| JP | S61-080840 | A | 4/1986 |
| JP | 2003-344722 | A | 12/2003 |
| JP | 2005-093675 | A | 4/2005 |
| WO | WO-2011/013581 | A1 | 2/2011 |
| WO | WO-2013/027669 | A1 | 2/2013 |

*Primary Examiner* — Joseph L Williams
(74) *Attorney, Agent, or Firm* — Foley & Lardner LLP

(57) ABSTRACT

A light emitting device includes a base having a supporting part and a frame part disposed on an upper surface of the supporting part; a light emitting element mounted on the upper surface of the supporting part at a location interior of the frame part; a cover body fixed to an upper surface of the frame part and defining an opening at a location interior of the frame part in a top view; and a light-transmissive body covering the at least one opening. The cover body includes: a first portion disposed on the upper surface of the frame part, a second portion extending inward from the first portion and then bending and extending upward or downward so as to be spaced from an inner lateral surface of the frame part or a plane that includes an inner lateral surface of the frame part, and a third portion connected to the second portion and defining the opening.

21 Claims, 6 Drawing Sheets

LIGHT EMITTING DEVICE AND METHOD OF MANUFACTURING LIGHT EMITTING DEVICE

CROSS-REFERENCE TO RELATED APPLICATION

This application claims priority to Japanese Patent Application No. 2015-148873 filed on Jul. 28, 2015, and Japanese Patent Application No. 2016-140086 filed on Jul. 15, 2016. The entire disclosures of Japanese Patent Application No. 2015-148873 and Japanese Patent Application No. 2016-140086 are hereby incorporated herein by reference.

BACKGROUND

The present disclosure relates to a light emitting device and a method of manufacturing the light emitting device.

There have been known light emitting devices having a base having an upper surface and defining a recess to mount an optical semiconductor element on a bottom surface of the recess, and a cover body bonded on the upper surface of the base, the cover body having a metal frame member defining an opening and a window body made of glass bonded to a periphery of the opening (for example, JP 2005-93675).

SUMMARY

Generally, stress may occur in a light emitting device due to differences in thermal expansion coefficients between the members. Such stress may result in plastic deformation of some of members, or further result in damage to the joining portion between the members and/or damage to the window body.

Accordingly, an aim of certain embodiments of the present invention is to provide a light emitting device of high reliability that reduces influences of the stress in the light emitting device.

A light emitting device according to one embodiment of the present invention includes a base having a supporting part and a frame part disposed on an upper surface of the supporting part, at least one light emitting element mounted on the upper surface of the supporting part at a location interior of the frame part, a cover body fixed to an upper surface of the frame part and defining at least one opening at a location interior of the frame part when viewed from above, and at least one light-transmissive body covering the at least one opening. The cover body has a first portion on the upper surface of the frame part, a second portion extending inward from the first portion and then bending and extending downward so as to be spaced from an inner lateral surface of the frame part, or a second portion extending inward from the first portion and then bending and extending upward so as to be spaced from a plane that includes the inner lateral surface of the frame part, and a third portion connected to the second portion and defining the at least one opening. A thickness of the second portion is greater than a thickness of the first portion, and a thickness of the third portion is greater than the thickness of the second portion.

A method of manufacturing a light emitting device according to certain embodiments of the present invention includes, providing a base having a supporting part and a frame part disposed on an upper surface of the supporting part, mounting at least one light emitting element on an upper surface of the supporting part at a location interior of the frame part, providing a supporting member that includes a first portion in a shape of a planar frame, and a second portion having a thickness greater than a thickness of the first portion and extending inward from the first portion, then bending and extending downward, and then further bending and extending inward, or a second portion having a thickness greater than a thickness of the first portion and extending inward from the first portion, then bending and extending upward, and then further bending and extending inward, providing a holding member that includes a third portion having a thickness greater than the thickness of the second portion and defining at least one opening, forming a cover body by joining the holding member to an upper surface or a lower surface of the portion of the supporting member that bends and extends inward, connecting at least one light-transmissive body on an upper surface or a lower surface of the holding member so as to cover the at least one opening, and fixing a lower surface of the first portion to an upper surface of the frame part so that an inner lateral surface of the frame part and the portion of the second portion that extends downward are spaced from each other, or so that a surface including the inner lateral surface of the frame part and the portion of the second portion extends upward are spaced from each other.

DETAILED DESCRIPTION OF EMBODIMENTS

Certain embodiments of the present invention will be described below with reference to the accompanying drawings. The embodiments are intended as illustrative of a light emitting device to give a concrete form to technical ideas of the present invention, and the scope of the invention is not limited to those described below. Particularly, the sizes, materials, shapes and the relative positions of the members described in examples are given as an example and not as a limitation to the scope of the invention unless specifically stated. The sizes and the positional relationships of the members in each of the drawings are occasionally shown exaggerated for ease of explanation.

First Embodiment

Figure 1:
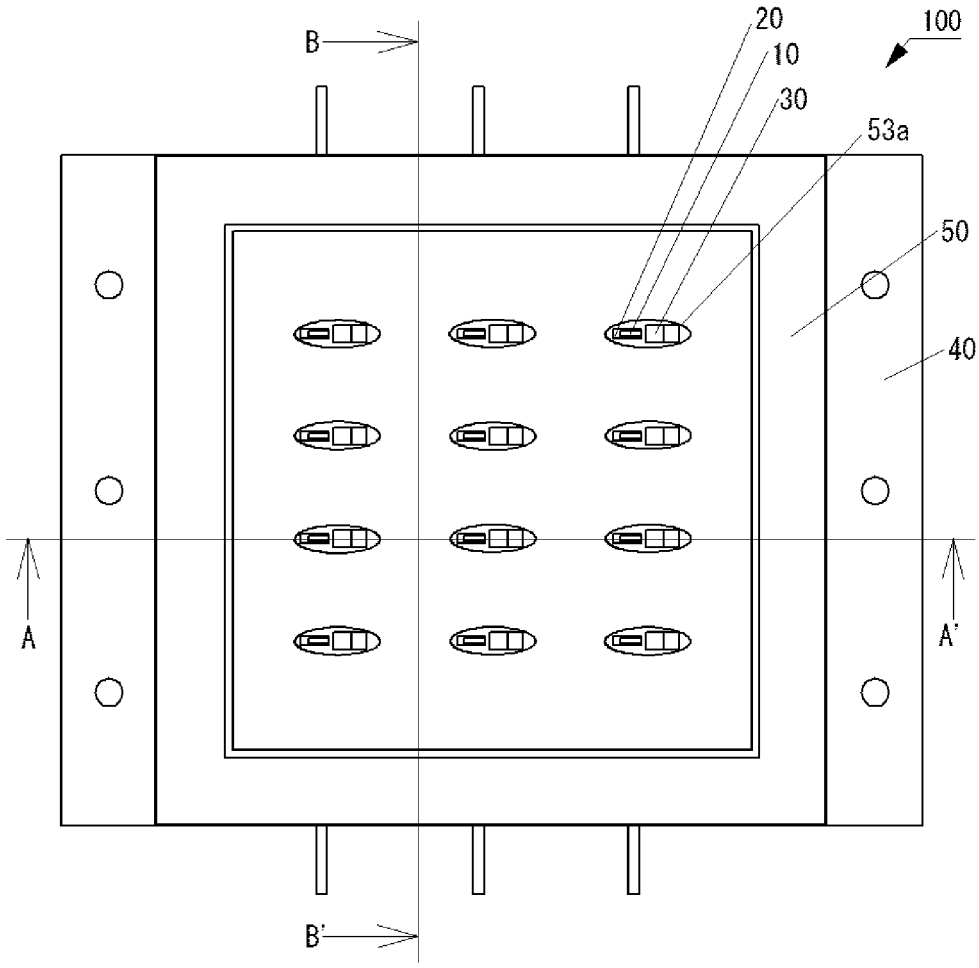
FIG. 1 is a schematic view seen from its light emitting surface side of a light emitting device according to a first embodiment.
Figure 2:
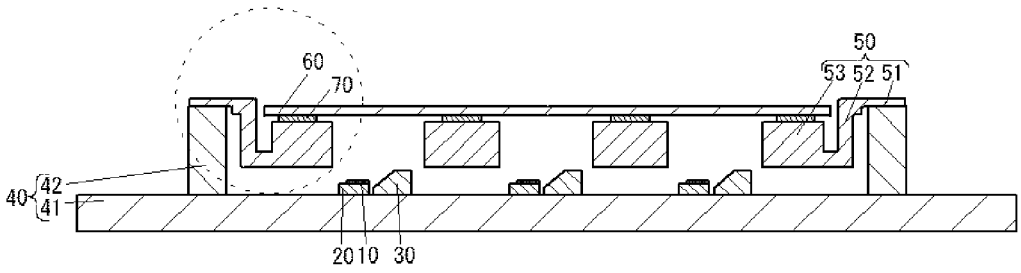
FIG. 2 is a schematic cross sectional view taken along line A-A' of FIG. 1.
Figure 3:
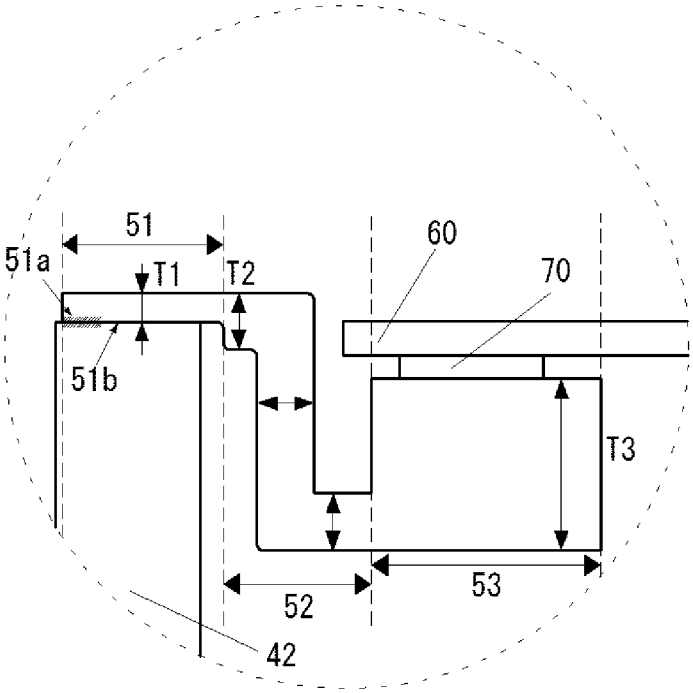
FIG. 3 is an enlarged view of a part enclosed by a broken line in FIG. 2.
Figure 4:
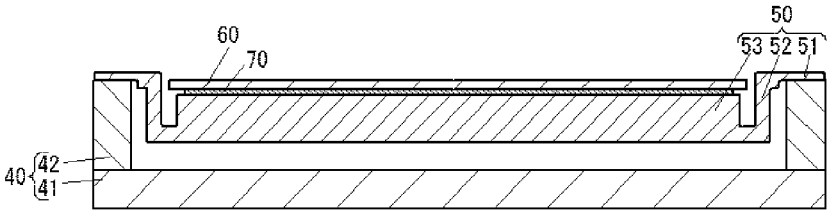
FIG. 4 is a schematic cross sectional view taken along line B-B' of FIG. 1.

FIG. 1 is a schematic view seen from its light emitting surface side (i.e., a top view) of a light emitting device 100 according to a first embodiment. FIG. 2 is a schematic cross sectional view of the light emitting device 100 taken along line A-A' of FIG. 1. FIG. 3 is an enlarged view of a part enclosed by a broken line in FIG. 2. FIG. 4 is a schematic cross sectional view taken along line B-B' of FIG. 1.

As shown in the figures, the light emitting device 100 includes a base 40 having a supporting part 41 and a frame part 42 disposed on an upper surface of the supporting part 41, at least one light emitting element 10 mounted on the upper surface of the supporting part 41 at a location interior of the frame part 42, a cover body 50 fixed to an upper surface of the frame part 42 and defining at least one opening 53*a* at a location interior of the frame part 42 in a top view, and at least one light-transmissive body 60 covering the at least one opening 53*a*. The cover body 50 has a first portion 51 disposed on the upper surface of the frame part 42, a second portion 52 extending inward from the first portion 51 and then bending and extending downward so as to be spaced from an inner lateral surface of the frame part 42, and a third portion 53 connected to the second portion 52 and defining the at least one opening 53*a*. Further, a thickness T2 (plate thickness) of the second portion 52 is greater than a thickness T1 of the first portion 51, and a thickness T3 of the third portion 53 is greater than the thickness T2 of the second portion 52.

With this arrangement, stress loaded on the cover body 50 and/or the light-transmissive body 60 can be reduced and the light emitting device 100 of high reliability can be obtained. More details thereof will be described below.

Generally, when a light emitting element is turned on, the light emitting element generates heat. A light emitting device is formed with plural number of members and upon applied with heat, stress may occur due to difference in thermal expanding coefficients between the members. The base may be warped by the stress, resulting in plastic deformation of the cover body. Also, upon warpage of the cover body due to stress, breakage of joining portions between the members, and/or damage of the light-transmissive body fixed to the cover body may further results.

Accordingly, in the present embodiment, the cover body 50 is provided with a first portion 51 arranged on an upper surface of a frame part 42, and a second portion 52 extending inward from the first portion 51 and bending and extending downward so as to be spaced from the inner lateral surface of the frame part 42. With this arrangement, within the cover body 50 a distance of the frame part 42 to a light-transmissive body 60 can be increased, so that the stress can be absorbed by a whole structure of the cover body 50. In particular, the second portion has a thickness T2 smaller than a thickness T3 of the third portion, and also the second portion 52 extends inward from the first portion 51 and then bends and extends downward so as to be spaced from the inner lateral surface of the frame part 42, thus facilitating elastic deformation at the bending portion (hereinafter may be referred to as "corner portions") and a portion extending downward from the bending portion. Meanwhile, stress tends to concentrate at the corner portions of the cover body 50. However, in the present embodiment, the corner portions have a thickness greater than the portions (of the first portions 51) fixed to the frame part 42 of the cover body, thus securing certain degree of mechanical strength. Accordingly, in the case of stress concentrating on the corner portions, plastic deformation of the cover body 50 at its corner portions can be largely reduced. Further, with the third portion having a thickness T3 greater than the thickness T2 of the second portion, deformation of the third portion 53 due to difference in thermal expanding coefficient between members can be largely reduced. Consequently, damage of the light-transmissive body 60 due to deformation of the third portion 53 can also be largely reduced.

The main components of the light emitting device 100 will be described below. In the present specification, for the simplicity of explanation, the light emitting surface side of the light emitting device 100 (upper side in FIG. 2) will be indicated as "upper side" and its opposite side (lower side in FIG. 2) will be indicated as a "lower side".

Base 40

The base 40 has a supporting part 41 and a frame part 42 disposed on an upper surface of the supporting part 41. The supporting part 41 and the frame part 42 of the base 40 define a recess. The shape of the frame part 42 may be appropriately selected, and as shown in FIG. 1 and FIG. 2, a quadrangular shape in a top view can be employed. With this arrangement, the frame part 42 can be in a straight shape, which can facilitate fixing of the cover body 50 to the frame part 42 by seam welding.

The supporting part 41 is preferably made of a material having high thermal conductivity in order to release heat from the one or more light emitting element 10. For the material having high thermal conductivity, for example, a metal material can be used. In the present embodiment, a material whose main component is copper is used for the supporting part 41. In the present specification, the expression "a material whose main component is copper" also include a material made singly of copper. For the supporting part 41, a material having a thermal expansion coefficient greater than that of the frame part 42 can be employed. This is because with a large thermal expansion coefficient, warpage may occur in the supporting part 41 and the supporting part 41 is easily subjected to stress, but according to the present embodiment, effects of the stress can be reduced.

The frame part 42 can be formed including at least either ceramic or a metal material, but at least a portion to be in contact with the cover body 50 is preferably made of a metal material. The cover body 50 is preferably made of a metal material. With this, the frame part 42 and the cover body 50 can be easily fixed by welding, which facilitates airtight sealing of the light emitting element 10. In the case of welding the frame part 42 and the cover body 50, at least either the frame part 42 or the cover body 50 is preferably made of a material having relatively low thermal conductivity. Generally, with the use of a material having relatively low thermal conductivity, heat generated at a welding portion at the time of welding can be hindered to be transferred to portions other than the welding portion, so that stable resistance welding can be performed. Examples of materials having a low thermal conductivity include materials whose main component is iron can be used. In the present embodiment, Kovar is used for the frame part 42 and the cover body 50, respectively.

Light Emitting Element 10

At least one light emitting element 10 is arranged on the upper surface of the supporting part 41 interior to the frame part 42. That is, the at least one light emitting element 10 is mounted on a bottom of the recess of the base 40. For the at least one light emitting element 10, for example, a light emitting diode (LED) or a laser diode (LD) can be used, and of those, an LD is preferably used. Generally, LDs generate a large quantity of heat per unit area, so that the supporting part 41 is needed to be made of a material of high thermal conductivity. Thus, stress due to the heat tends to occur throughout the light emitting device, but according to the present embodiment, effects of the heat can be reduced.

For the light emitting element 10, element made of a nitride semiconductor can be used. In particular, an LD made of a nitride semiconductor has a high light density in its light emission surface, on which dust tends to collect. Thus, airtightness becomes a critical requirement. In this respect, according to the present embodiment, occurrence of cracks in the light-transmissive body 60 can be largely reduced by the thick third portion 53, facilitating maintaining of the airtightness.

In the present embodiment, for the at least one light emitting element 10, an LD to emit blue light made of nitride semiconductors is employed. The at least one light emitting element 10 is arranged on the upper surface of the supporting part 41 so that laser light can be emitted in a direction substantially parallel to the upper surface of the supporting part 41. The laser light emitted from each light emitting element 10 is reflected by a reflecting member 30 in a direction substantially perpendicular to the upper surface of the supporting part 41. Further, in the present embodiment, the at least one light emitting element 10 is mounted on the upper surface of the supporting part 41 via a sub-mount 20 made of ceramic such as aluminum nitride or silicon carbide.

At least one reflecting member 30 is mounted on the upper surface of the supporting part 41, and is configured to reflect light from corresponding light emitting element 10 in a predetermined direction. The structure of the reflecting member 30 can be appropriately selected. In the present embodiment, the at least one reflecting member 30 is made of an optical glass with an inclined surface formed in a part, and a reflecting film is formed on the inclined surface. The shape of the reflecting member 30 can be a triangular prism where the inclined surface and the upper surface of the supporting part 41 are at an angle of about 45 degrees, for example.

In the example shown in the present embodiment, a plurality of light emitting elements 10 are used in a single light emitting device 100, but a single light emitting element 10 may be used in a single light emitting device 100. With the use of a plurality of light emitting elements 10, an entire optical output can be improved, but the quantity of heat generates as a whole also increases. However, according to the present embodiment, effects of heat can be largely reduced, which is particularly advantageous in using a plurality of light emitting elements 10. Moreover, in the example shown in the present embodiment, each of a plurality of reflecting members 30 are provided to each of the plurality of the light emitting elements 10, but light from two or more light emitting elements 10 can be reflected by a single reflecting member 30.

Cover Body 50

The cover body 50 has a first portion 51 arranged on the upper surface of the frame part 42, a second portion 52 extending inward from the first portion 51 and then bending and extending downward so as to be spaced from an inner lateral surface of the frame part 42, and a third portion 53 defining at least one opening 53*a* and connected to the second portion 52. The thickness T2 of the second portion 52 is greater than the thickness T1 of the first portion 51, and the thickness T3 of the third portion 53 is greater than the thickness T2 of the second portion 52. The second portion 52 is bent downward so as to be separated from the inner lateral surface of the frame part 42. With this arrangement, the size of the light emitting device can be reduced and elastic deformation of the second portion 52 can absorb the stress.

The first portion 51 is at least partially located on and fixed to the upper surface of the frame part 42. The first portion 51 preferably has a connecting region 51*a* connected onto the upper surface of the frame part 42 and a non-connecting region 51*b* located interior to the connecting region 51*a* and is not connected to the upper surface of the frame part 42. For example, as shown in FIG. 3, the first portion 51 and the frame part 42 are fixed in the vicinity of the outer edge of the upper surface of the frame part 42 to form the connecting region 51*a*. In this case, at portions interior to the connecting region 51*a*, the first portion 51 and the frame part 42 are not connected to provide a non-connecting region 51*b*. With this arrangement, the portion of the first portion 51 that is not connected to the frame part 42 can also absorb the stress.

In order to maintain the mechanical strength, the first portion 51 can have a thickness T1 of preferably 0.05 mm or greater, more preferably 0.08 mm or greater, further preferably 0.1 mm or greater. Meanwhile, in view of ease of welding and of absorption of stress, the first portion 51 can have a thickness T1 of preferably 0.25 mm or less, more preferably 0.2 mm or less, further preferably 0.15 mm or less, especially preferably 0.12 mm or less. As shown in FIG. 3, the "thickness T1 of the first portion 51" refers to a length in a direction substantially perpendicular to the upper surface of the frame part 42 (i.e., up-and-down direction in FIG. 3).

The width of the first portion 51 is preferably at least larger than the width of the frame part 42. Further, the first portion 51 is preferably provided interior to the plane that includes the inner lateral surface of the frame part 42. This is because with an elongated, relatively thin first portion 51 can further facilitate absorption of the stress. The "width of the first portion 51" refers to a length in a direction substantially perpendicular to the inner lateral surface of the frame part 42 (i.e. left-and-right direction in FIG. 3).

The second portion 52 includes a portion that extends inward from the first portion 51 and then bends and extends downward. At this time, the portion of the second portion 52 that extends downward is spaced from the inner lateral surface of the frame part 42. With this arrangement, the portion of the second portion 52 that extends downward can be easily elastically deformed, which facilitates absorption of the stress.

In order to maintain the mechanical strength of the corner portion (s), the second portion 52 can have a thickness T2 of preferably 0.1 mm or greater, more preferably 0.13 mm or greater, further preferably 0.2 mm or greater. Meanwhile, in view of ease of welding and of absorption of stress at the second portion 52, the second portion 52 can have a thickness T2 of preferably 0.35 mm or less, more preferably 0.3 mm or less, further preferably 0.2 mm or less, especially preferably 0.15 mm or less. As shown in FIG. 3, the "thickness T2 of the second portion 52" refers that a length in an up-and-down direction in FIG. 3 from the first portion 51 to an corner, a length in a left-and-right direction in FIG. 3 from the corner to a portion extending downward, and a length in the up-and-down direction in FIG. 3 from a portion further extending inward from the downward extending portion, respectively. The thickness T2 of the second portion 52 may partially vary within a range where the thickness T2 of the second portion 52 is greater than the thickness T1 of the first portion 51 and smaller the thickness T3 of the third portion 53.

In order to absorb stress, a portion of the second portion 52 extending downward can have a length preferably 1 mm or greater, more preferably 2 mm or greater. Meanwhile, in view of easy handling, the portion of the second portion 52 extending downward can have a length preferably 6 mm or less, more preferably 3 mm or less.

The third portion 53 has at least one opening 53*a*. The at least one opening 53*a* is formed to allow light from the light emitting element 10 to pass through. In the case where a plurality of light emitting elements 10 are disposed on the supporting part 41, a single opening 53*a* may be formed, but as in the present embodiment, a plurality of openings 53*a* are preferably formed so that respectively correspond to light from the plurality of light emitting elements 10. In the present embodiment, the openings 53*a* are arranged so that a plurality of openings 53*a* overlaps a plurality of light emitting elements 10 respectively in a transmission plan view. With this arrangement, the third portion 53 located between the openings 53*a* can be used for connecting to the light-transmissive body 60, so that a connection area between the third portion 53 and the light-transmissive body 60 can be increased, and mechanical strength of the light-transmissive body 60 can be improved.

In order to reduce deformation of the third portion 53 due to stress, the third portion 53 preferably has a thickness T3 of 0.4 mm or greater, more preferably 0.6 mm or greater, further preferably 0.8 mm or greater. Meanwhile, in order to prevent light of the light emitting element 10 from incident on a lateral surface of the opening 53*a*, the third portion 53 has a thickness T3 of preferably 2.0 mm or less, more preferably 1.5 mm or less, further preferably 1.2 mm or less. In the present specification, the "thickness T3 of the third portion 53" refers to a length in the up-and-down direction in FIG. 3.

Light-transmissive Body 60

At least one light-transmissive body 60 is arranged to close corresponding each of the at least one opening 53*a*. The light-transmissive body 60 may be disposed interior of the opening 53*a*, but preferably disposed on the upper surface of the third portion 53 as in the present embodiment. With this arrangement, connection between the light-transmissive body 60 and the third portion 53 can be facilitated. For the light-transmissive body 60, glass, sapphire, or the like, can be employed.

In the case of forming a plurality of the openings 53*a*, a plurality of light-transmissive bodies 60 may be disposed to close respective one of plurality of the openings 53*a*, but preferably one light-transmissive body 60 is provided to close the plurality of openings 53*a* as in the present embodiment. In the case of using a large light-transmissive body 60, effects of the stress are more likely applied, so that effects of the present embodiment can be more apparently exhibited.

The light-transmissive body 60 has a thickness preferably 0.2 mm or greater, more preferably 0.3 mm or greater, in view of securing the strength of the light-transmissive body 60. Meanwhile, in view of miniaturization of the light emitting device 100, the light-transmissive body 60 has a thickness preferably 1.5 mm or less, more preferably 1.0 mm or less.

In the present embodiment, the light-transmissive body 60 is arranged on the upper surface of the third portion 53 so that the upper surface of the light-transmissive body 60 is lower than the upper surface of the second portion 52. With this arrangement, other members located outside of the light emitting device 100 are not easily brought in touch with the light-transmissive body 60, so that damage of the light-transmissive body 60 can be reduced.

As in the present embodiment, in the case where the second portion 52 extends downward and the light-transmissive body 60 is arranged above the third portion 53, the size of the light-transmissive body 60 is preferably increased to a degree so that the outer periphery of the light-transmissive body 60 is not in contact to the second portion 52 in a top view. In view of elastic deformation at the second portion 52, the separation distance between the light-transmissive body 60 and the second portion 52 in a lateral direction (i.e., principal plane direction of the light-transmissive body) can be preferably 10 μm or greater, more preferably 50 μm or greater. Meanwhile, in order to prevent an increase in the size of the light emitting device 100, the separation distance between the light-transmissive body 60 and the second portion 52 can be preferably 500 μm or less, more preferably 200 μm or less. The separation distance as used in the specification refers to a minimum distance between the light-transmissive body 60 and the second portion 52.

In the present embodiment, the upper surface of the third portion 52 and the lower surface of the light-transmissive body 60 are connected, but alternatively, the lower surface of the third portion 53 and the upper portion of the light-transmissive body 60 can be connected.

Bonding Member 70

The light-transmissive body 60 and the third portion 53 are connected by a bonding member 70. In the present embodiment, low-melting-point glass is used for the bonding member 70. For the bonding member 70, a material having thermal expansion coefficient close to those of the light-transmissive body 60 and the third portion 53 is preferably used. With this, stress that occurred due to difference in the materials can be reduced and airtightness can be secured.

Second Embodiment

Figure 5:
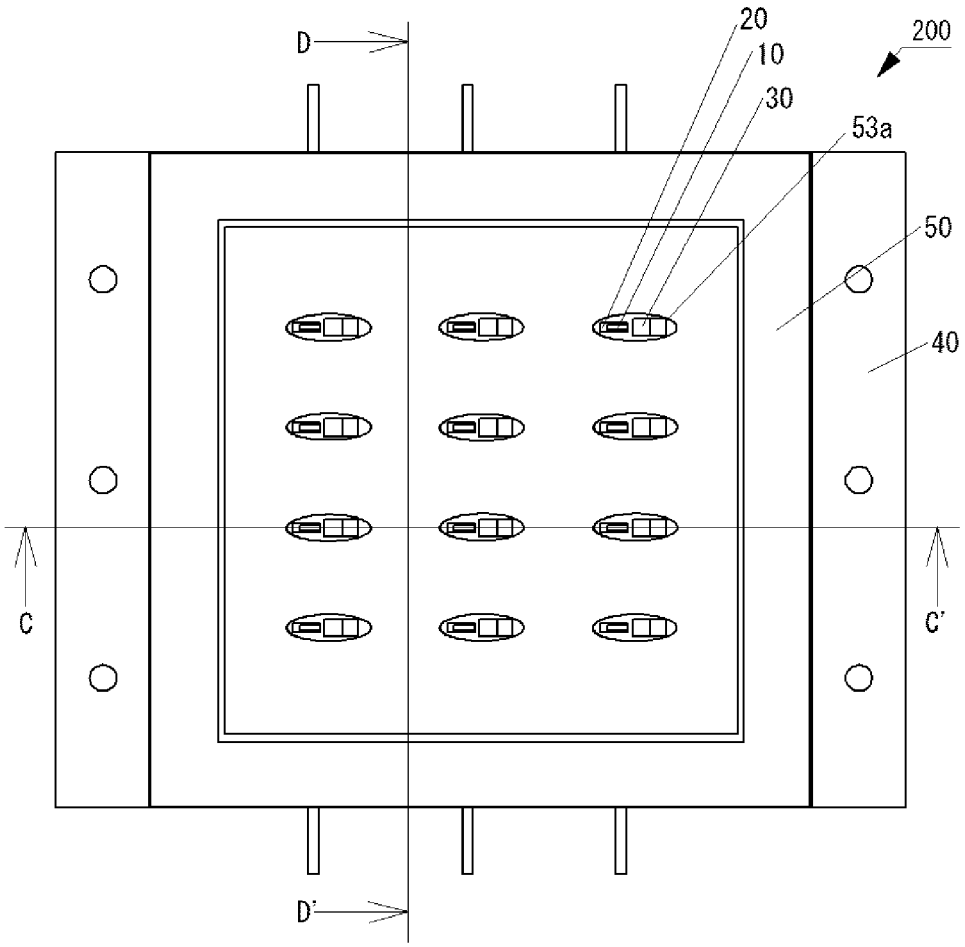
FIG. 5 is a schematic view seen from its light emitting surface side of a light emitting device according to a second embodiment.
Figure 6:
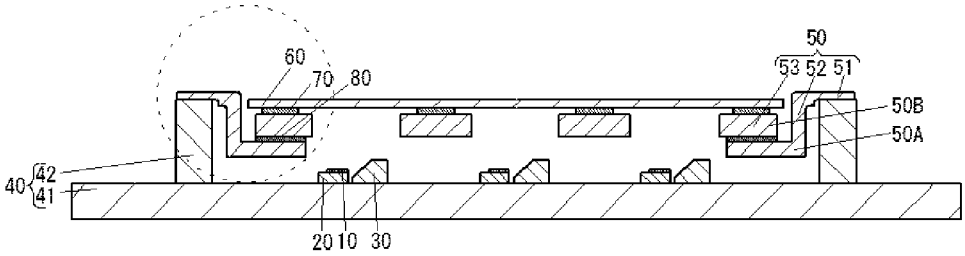
FIG. 6 is a schematic cross sectional view taken along line C-C' of FIG. 5.
Figure 7:
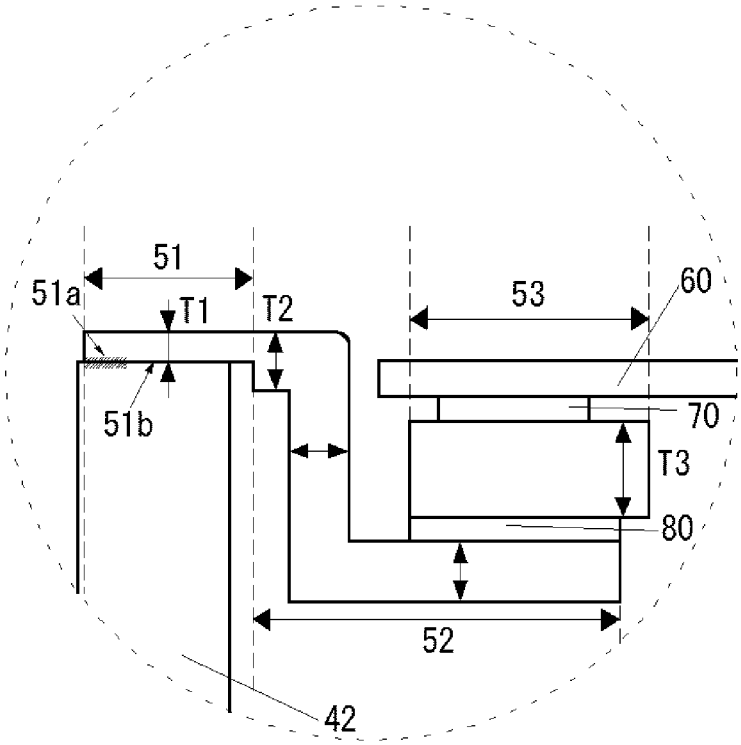
FIG. 7 is an enlarged view of a part enclosed by a broken line in FIG. 6.
Figure 8:
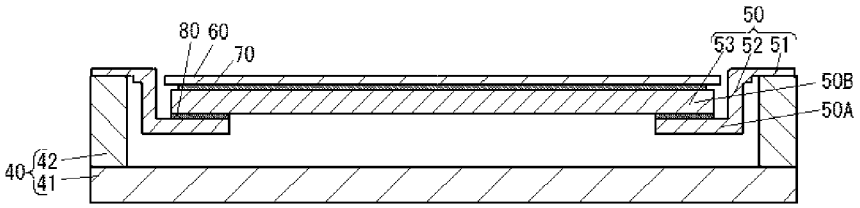
FIG. 8 is a schematic cross sectional view taken along line D-D' of FIG. 5.

FIG. 5 is a schematic view seen from its light emitting surface side of a light emitting device according to a second embodiment. FIG. 6 is a schematic cross sectional view of the light emitting device 200 taken along line C-C' of FIG. 5. FIG. 7 is an enlarged view of a part enclosed by a broken line in FIG. 6. FIG. 8 is a schematic cross sectional view taken along line D-D' of FIG. 5. The light emitting device 200 has substantially similar features as described in Embodiment 1 except for the features to be described below.

In the light emitting device 200, a cover body 50 is formed with a supporting member 50A that includes a first portion 51 and a second portion 52, and a holding member 50B that includes a third portion 53. That is, the cover body 50 is formed with a plurality of members. With this configuration, even when integral forming of the cover body 50 is difficult due to difference in the thickness between the first and second portions 51, 52 and the third portion 53, each portion can be formed by press working or the like and then joined to each other. Thus, the cover body 50 can be formed easily.

A method of manufacturing a light emitting device 200 according to the present embodiment includes, providing a base 40 having a supporting part 41 and a frame part 42 disposed on an upper surface of the supporting part 41, mounting at least one light emitting element 10 on the upper surface of the supporting part 41 at a location interior of the frame part 42, providing a supporting member 50A that includes a first portion 51 in a shape of a planer frame, and a second portion 52 having a thickness greater than a thickness of the first portion 51 and extending inward from the first portion 51, then bending and extending downward, and then further bending and extending inward, providing a holding member 50B that includes a third portion 53 having a thickness greater than the thickness of the second portion 52 and defining at least one opening 53*a*, forming a cover body 50 by joining a lower surface of the holding member 50B to an upper surface of the portion of the supporting member 50A which bends and extends inward, connecting at least one light-transmissive body 60 on an upper surface of the holding member 50B so as to cover the at least one opening 53*a*, and fixing a lower surface of the first portion 51 on the upper surface of the frame part 42 so that the inner lateral surface of the frame part 42 and the portion of the second portion 52 extends downward are spaced from each other.

As described above, individually forming the first and second portions 51, 52 and the third portion 53 that have a large difference in the thickness, and then joining to each other to form the cover body 50 can facilitate formation of the cover body 50 and can improve the mass productivity.

The supporting member 50A and the holding member 50B can be formed either with the same material or different materials. In the case where different materials are used, the materials are preferably selected so that the thermal expansion coefficient of the holding member 50B is closer to the thermal expansion coefficient of the light-transmissive body 60 than to the thermal expansion coefficient of the supporting member 50A. With this, occurrence of stress due to difference in the thermal expansion coefficient can be reduced and occurrence of fracture in the light-transmissive body 60 can be largely reduced.

The supporting member 50A and the holding member 50B can be formed by using a known processing method. Of those, a press working is employed in the present embodiment. With this, processing time can be largely reduced and mass production with stable accuracy becomes possible.

Joining Member 80

In the light emitting device 200, an upper surface of a portion of the second portion 52 that is bent inward and extending and a lower surface of the third portion 53 are joined by a joining member 80. In this joining, a material having a Young's modulus smaller than that of the supporting member 50A and the holding member 50B is preferably used for the joining member 80. With this, stress can also be absorbed by the joining member 80. For the material of the joining member 80, a brazing material can be used, and for example, silver solder can be used.

The joining member 80 may have a thickness of preferably 3 μm or greater, more preferably 10 μm or greater, in view of reducing stress. Meanwhile, in view of securing the mechanical strength of the joining part, the joining member 80 has a thickness preferably 200 μm or less, more preferably 100 μm or less.

In the present embodiment, the second portion 52 is formed extending inward from the first portion 51 and then bending and extending downward, but the second portion 52 can be formed extending inward from the first portion 51 and then bending and extending upward.

Third Embodiment

Figure 9:
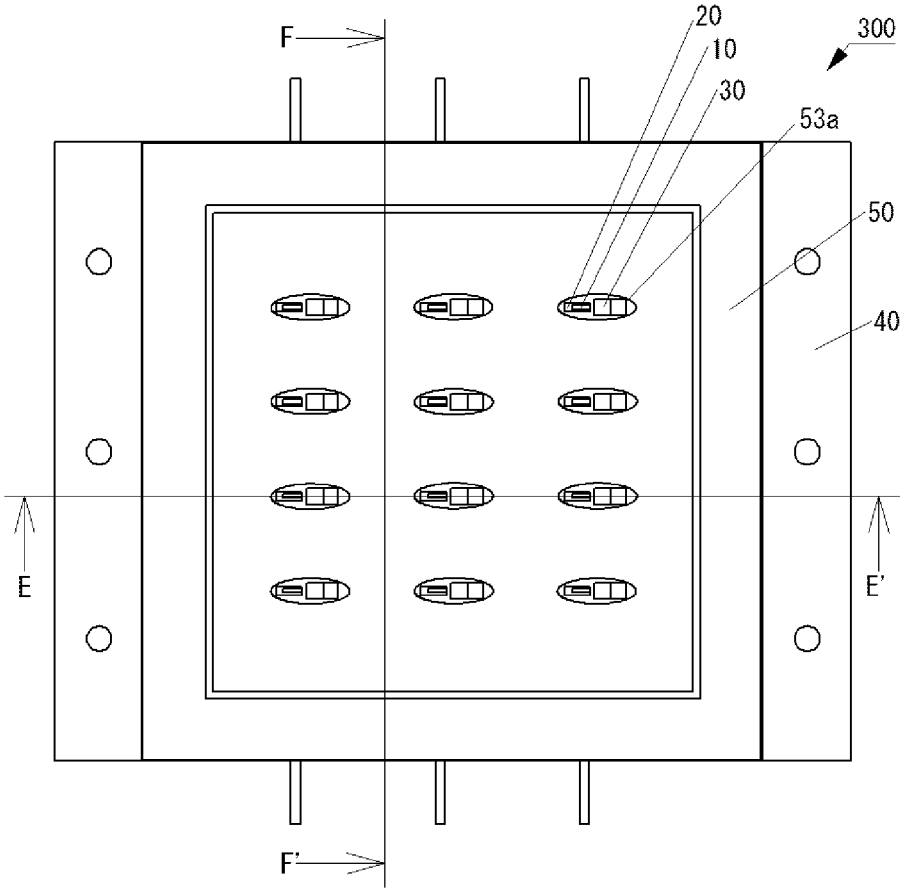
FIG. 9 is a schematic view seen from its light emitting surface side of a light emitting device according to a third embodiment.
Figure 10:
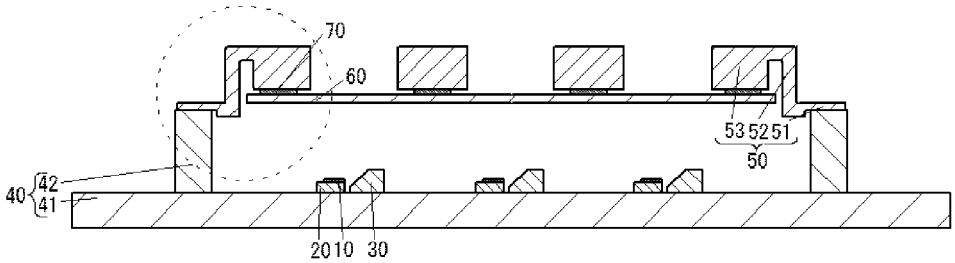
FIG. 10 is a schematic cross sectional view taken along line E-E' of FIG. 9.
Figure 11:
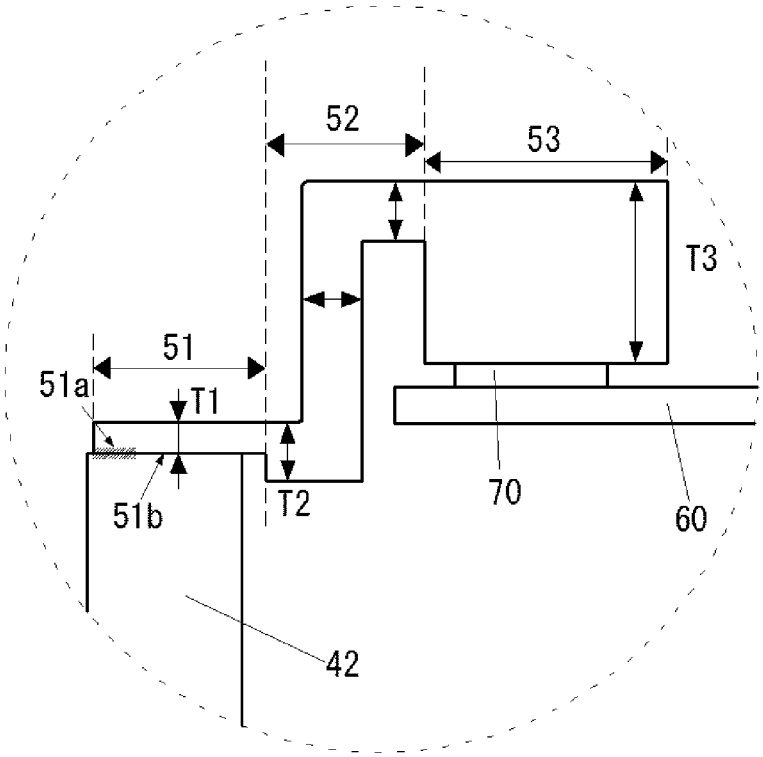
FIG. 11 is an enlarged view of a part enclosed by a broken line in FIG. 10.
Figure 12:
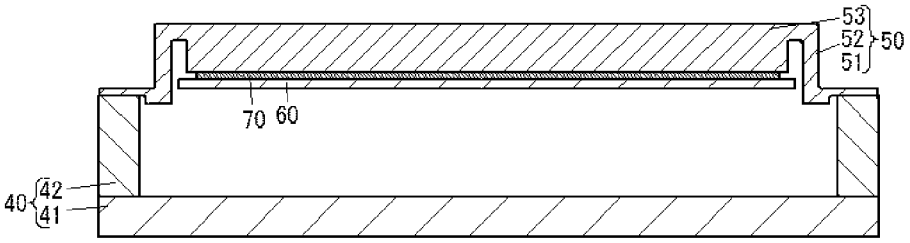
FIG. 12 is a schematic cross sectional view taken along line F-F' of FIG. 9.

FIG. 9 is a schematic view of a light emitting device 300 according to a third embodiment viewed from its light emitting surface side. FIG. 10 is a schematic cross sectional view of the light emitting device 300 taken along line E-E' of FIG. 9. FIG. 11 is an enlarged view of a part enclosed by a broken line in FIG. 10. FIG. 12 is a schematic cross sectional view taken along line F-F' of FIG. 9. The light emitting device 300 has substantially similar features as described in Embodiment 1 except for the features to be described below.

In the light emitting device 300, a second portion 52 of a cover body 50 extends inward from a first portion 51 and then bends upward so as to be spaced from a plane that includes an inner lateral surface of the frame part 42. That is, the cover body 50 has an upwardly protruding shape. Also, a lower surface of the second portion 52 and an upper surface of a light-transmissive body 60 are bonded. In the present specification, "a plane including an inner lateral surface of the frame part 42" refers to an imaginary flat surface that includes and extends from an inner lateral surface of the frame part 42.

Also in the present embodiment, stress can be absorbed by the cover body 50 and stress loaded on the light-transmissive body 60 can be reduced. At this time, bonding the lower surface of the third portion 53 and the upper surface of the light-transmissive body 60 can prevent an increase in the size of the light emitting device 300.

In the case as shown in FIG. 11, a connecting region 51*a* of the first portion 51 is located near an outer edge of the upper surface of the frame part 42 and a non-connecting region 51*b* is located interior to the connecting region 51*a*, the second portion 52 may be bent upward at an outer side to the inner lateral surface of the frame part 42. That is, corner portion (s) of the second portion 52 may be arranged on the upper surface of the frame part 42. Also in this case, stress can be absorbed by the non-connecting region 51*b*, so that stress loaded on the cover body 50 and the light-transmissive body 60 can be reduced.

In the present embodiment, the cover body 50 may be formed with a plurality of members as in the second embodiment.

The light emitting devices described in the embodiments above can be used for various light emitting devices such as light sources for lighting, light sources for displays, light sources for projectors. It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

What is claimed is:

1. A light emitting device comprising:

a base having a supporting part and a frame part disposed on an upper surface of the supporting part;

at least one light emitting element mounted on the upper surface of the supporting part at a location interior of the frame part;

a cover body fixed to an upper surface of the frame part and defining at least one opening at a location interior of the frame part in a top view; and at least one light-transmissive body covering the at least one opening;

wherein the cover body includes:

a first portion disposed on the upper surface of the frame part, a second portion extending inward from the first portion and then bending and extending downward so as to be spaced from an inner lateral surface of the frame part, or a second portion extending inward from the first portion and then bending and extending upward so as to be spaced from a plane that includes an inner lateral surface of the frame part, and a third portion connected to the second portion and defining the at least one opening, wherein a thickness of the second portion is greater than a thickness of the first portion, and wherein a thickness of the third portion is greater than the thickness of the second portion.

2. The light emitting device according to claim 1, wherein:

the cover body comprises a supporting member including the first portion and the second portion, and a separate holding member including the third portion;

the second portion extends downward or upward then further bends inward; and the second portion and the third portion are joined by a joining member.

3. The light emitting device according to claim 2, wherein (i) a thermal expansion coefficient of a material from which the holding member is made is closer to (ii) a thermal expansion coefficient of a material from which the light-transmissive body is made than to (iii) a thermal expansion coefficient of a material from which the supporting member is made.

4. The light emitting device according to claim 2, wherein the joining member is a brazing material.

5. The light emitting device according to claim 1, wherein a thermal expansion coefficient of a material from which the supporting part is made is greater than a thermal expansion coefficient of a material from which the frame part is made.

6. The light emitting device according to claim 5, wherein the supporting part is made of a material whose main component is copper, and the frame part is made of a material whose main component is iron.

7. The light emitting device according to claim 6, wherein a plurality of the light emitting elements are mounted on the upper surface of the supporting part.

8. The light emitting device according to claim 7, wherein:

a plurality of the openings are defined by the cover body so as to respectively correspond to light from the plurality of light emitting elements, and a single light-transmissive body is disposed to cover the plurality of openings.

9. The light emitting device according to claim 8, wherein the light-transmissive body and the third portion are connected by a low-melting-point glass.

10. The light emitting device according to claim 5, wherein the second portion extends inward from the first portion and then bends and extends downward.

11. The light emitting device according to claim 6, wherein on the upper surface of the frame part, the first portion has a connecting region that is connected to the upper surface of the frame part and a non-connecting region that is located interior to the connecting region and is not connected to the upper surface of the frame part.

12. The light emitting device according to claim 1, wherein the at least one light emitting element is a laser diode using a nitride semiconductor.

13. The light emitting device according to claim 12, wherein at least one light-reflecting member is disposed on the upper surface of the supporting part corresponding to one or more of the at least one light emitting element such that light from the at least one light emitting element is reflected by the at least one light-reflecting member toward a corresponding opening.

14. The light emitting device according to claim 13, wherein the frame part has a quandrangular shape in a top view.

15. The light emitting device according to claim 14, wherein the light-transmissive body is arranged on an upper surface of the third portion such that an upper surface of the light-transmissive body is lower than an upper surface of the second portion.

16. A method of manufacturing a light emitting device comprising:

providing a base having a supporting part and a frame part disposed on an upper surface of the supporting part;

mounting at least one light emitting element on the upper surface of the supporting part at a location interior of the frame part;

providing a supporting member including:

a first portion in a shape of planar frame, and a second portion having a thickness greater than a thickness of the first portion and extending inward from the first portion, then bending and extending downward, and then further bending and extending inward, or a second portion having a thickness greater than a thickness of the first portion and extending inward from the first portion, then bending and extending upward, and then further bending and extending inward;

providing a holding member including a third portion having a thickness greater than the thickness of the second portion and defining at least one opening;

forming a cover body by joining the holding member to an upper surface or a lower surface of the portion of the supporting member that bends and extends inward;

connecting at least one light-transmissive body on an upper surface or a lower surface of the holding member so as to cover the at least one opening; and fixing a lower surface of the first portion to an upper surface of the frame part so that an inner lateral surface of the frame part and the portion of the second portion that extends downward are spaced from each other, or so that a plane including the inner lateral surface of the frame part and the portion of the second portion that extends upward are spaced from each other.

17. The method of manufacturing a light emitting device according to claim 16, wherein, in the step of providing the supporting member, the first portion and the second portion are formed by press working.

18. The method of manufacturing a light emitting device according to claim 17, wherein, in the step of fixing the lower surface of the first portion to an upper surface of the frame part, the fixing is carried out by seam welding.

19. The method of manufacturing a light emitting device according to claim 18, wherein, in the step of fixing the lower surface of the first portion to the upper surface of the frame part, the first portion and the frame part are connected in the vicinity of an outer edge of the upper surface of the frame part, and the first portion and the frame part are not connected in the vicinity of an inner edge of the upper surface of the frame part.

20. The method of manufacturing a light emitting device according to claim 19, wherein the frame part has a quandrangular shape in a top view.

21. The method of manufacturing a light emitting device according to claim 20, wherein, in the step of forming the cover body, the supporting member and the holding member are joined by using a material having a Young's modulus smaller than Young's modulus of a material from which the supporting member and the holding member are made.

* * * * *